United States Patent [19]

Humphreys, Jr.

[11] Patent Number: 4,938,040

[45] Date of Patent: Jul. 3, 1990

[54] SECURING DEVICE FOR SURFBOARDS

[76] Inventor: William J. Humphreys, Jr., 26981 Ayamonte, Mission Viejo, Calif. 92692

[21] Appl. No.: 464,007

[22] Filed: Jan. 12, 1990

[51] Int. Cl.[5] ..... E05B 73/00

[52] U.S. Cl. ..... 70/58; 70/14

[58] Field of Search ..... 70/14, 32, 33, 34, 57, 70/58, 18

[56] References Cited

U.S. PATENT DOCUMENTS

| | | | |
|---|---|---|---|
| 4,340,376 | 7/1982 | Williams | 70/58 |
| 4,546,627 | 10/1985 | Shrawder | 70/18 |
| 4,680,949 | 7/1987 | Stewart | 70/14 |
| 4,712,394 | 12/1987 | Bull . | |
| 4,820,220 | 4/1989 | Fruzzetti . | |

*Primary Examiner*—Robert L. Wolfe

[57] ABSTRACT

A securing device for surfboards comprising a mechanism securely attached to a length of cable with the cable having a fixed loop at its end opposite the mechanism. The mechanism consists of a body and a sleeve both containing complementary notches and holes which allow the device to attach to the metal pin contained in a surf leash anchoring device, commonly referred to as a "leash plug". Once attached to the leash plug, the securing device permits attachment of a typical mid-sized padlock which when locked prevents the removal of the securing device from the leash plug. Prior to attaching the securing device to the leash plug, the user wraps the cable around a fixed object, then passes the securing device through the fixed loop in the cable, forming a secure attachment to the fixed object. Additionally, the mechanism and cable may be put through any objects with openings large enough to allow the passage of the mechanism and cable, such as a wetsuit sleeve or leg. The user then attaches the securing device to the leash plug and locks it in place with a padlock, preventing the removal of the surfboard and any objects that have had the device passed through them.

2 Claims, 3 Drawing Sheets

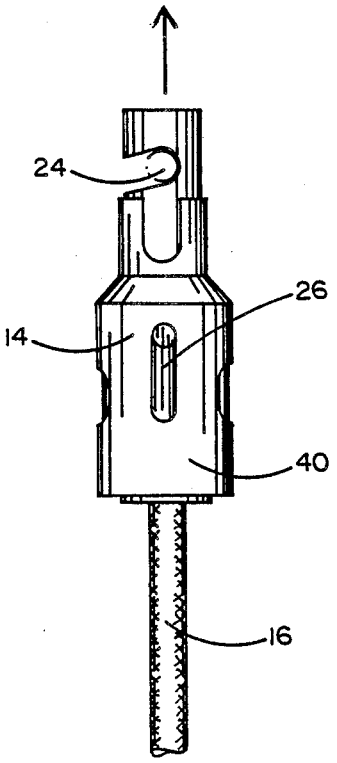
FIG. 6
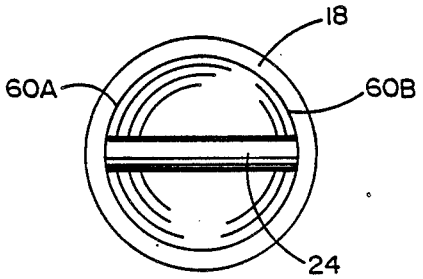
FIG. 8
FIG. 7
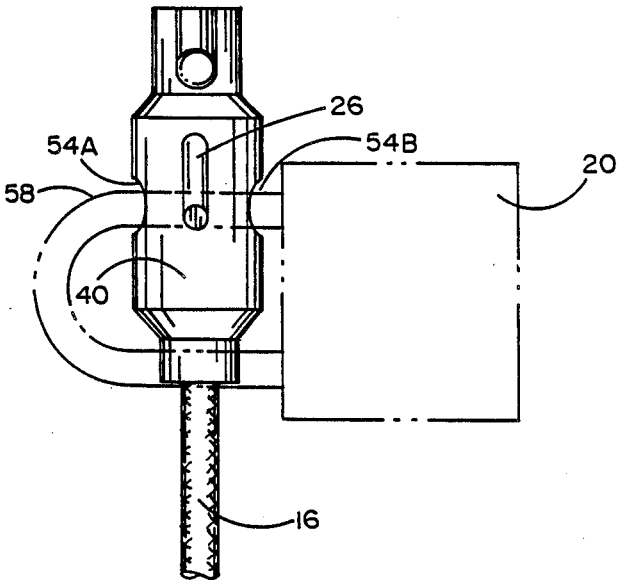

SECURING DEVICE FOR SURFBOARDS

BACKGROUND OF THE INVENTION

1. Field of the Invention

This invention relates to the security art and, more particularly, to a securing device for surfboards and related recreational implements, to prevent their theft. The securing device for surfboards according to the present invention provides a means for securely attaching a mechanism with an attached length of cable that is capable of being locked in place with a padlock to the surf leash anchoring device sealed within a cavity in the upper surface of a surfboard. Such anchoring devices, commonly and hereinafter referred to as "leash plugs," are installed on most surfboards to provide a tie point for the attachment of a surf leash. Surf leashes, such as those described in U.S. Pat. Nos. 4,041,562 and 4,610,634 are used to facilitate the retrieval of the surfboard when its user falls into the water. In use, the securing device is attached to a fixed object prior to being secured to the leash plug. Once the securing device is locked in place to the leash plug with a padlock, the removal of the surfboard is prevented.

2. Description of the Prior Art

Heretofore, some surfboard locking mechanisms have required that special attachments be permanently attached to the surfboard. These attachments are not common to surfboard construction, and require special installation. Two prior art surfboard securing devices, U.S. Pat. Nos. 4,712,394 and 4,820,220, both require modification of the surfboard by requiring the installation of special attachments. Other standard locks or cables must encircle the surfboard to secure it, possibly damaging the fragile fiberglass exterior of the surfboard.

The present invention overcomes these problems by providing a securing device designed and constructed to enable it to attach to the leash plug that is installed on most surfboards. The most commonly used leash plug consists of a small cylindrical plastic plug securely mounted flush within the flat upper surface of a surfboard. A metal pin is radially disposed between the inner cylindrical wall surfaces of the plug and attached securely thereto providing an attachment for a surf leash. Because of the relatively small size and configuration of typical leash plugs, attachment of conventional padlocks or cables to the leash plug pin is not possible. By design, the present invention attaches to the existing leash plug and there is less risk of damaging the fragile exterior of a surfboard, nor are modifications of the surfboard necessary.

It is a further object of the invention to provide a device which is quick and easy to operate within a beach environment.

SUMMARY OF THE INVENTION

Accordingly, it is an object of the present invention to provide a securing device for surfboards, and related recreational implements which is used to lock the surfboard to a fixed object.

It is yet another object of the present invention to be constructed to allow the securing device to be attached to the metal pin contained within a leash plug that is installed on virtually all surfboards. Due to the ability to attach to the leash plug, no modifications to the surfboard are necessary.

More particularly, there is provided a device which comprises a means for attaching a mechanism and its attached cable to the metal pin contained in the leash plug that is found in virtually all surfboards. Once the device is attached to the metal pin of the leash plug in a closed position, there are provided holes through the mechanism permitting the shackle of a typical mid-sized padlock to be passed through. Once the padlock is locked the device is held in a closed position securely attached to the leash plug. Prior to securing the mechanism, the cable is positioned around a fixed object, thereby creating a system which once secured, prevents the removal of the surfboard. As an option, prior to securing the device to the leash plug, the user may put the mechanism with attached cable through any number of objects containing an opening large enough for the device, such as the opening in a wetsuit sleeve or leg. Once the securing device is locked to the surfboard, these objects will be secured as well. Other uses may become evident in the following description.

DESCRIPTION OF DRAWINGS

FIG. 6 is a perspective view of the body and sleeve of the securing device in an open position and a cross section view of the metal pin of a leash plug.

FIG. 7 is a perspective view of the securing device in a locked position with a padlock, and cross section view of the metal pin of the leash plug.

FIG. 8 is an end view of a leash plug containing a metal pin.

DRAWING REFERENCE NUMERALS

10 Surfboard
12 Fixed Object
14 Securing Device
16 Cable
18 Leash Plug
20 Padlock
22 Fixed Loop in Cable 16
24 Metal Pin in Leash Plug 18
26 Body of Securing Device 14
27 Hole for Padlock 20
28 Rear end of Body 26
30 Center of Body 26
32 Front of Body 26
33 Transition of Rear 28 to Front 32
34 Notch in Body 26
36 Pin
38 Hole in Body 26 for Pin 36
40 Sleeve of Securing Device 14
42 Rear of Sleeve 40
44 Front of Sleeve 40
46 Transition of Rear 42 to Front 44
48 Groove in Sleeve 40 for Pin 36
50 Notch in Sleeve 40
52 Wall of Front Section 44 of Sleeve 40
54 A and B Holes in Sleeve 40 for Padlock 20

56 A and B Walls of Sleeve 40 adjacent to Notch 50
58 Shackle of Padlock 20
60 A and B Opposite Walls of Leash Plug 18

DESCRIPTION OF INVENTION

Figure 1:
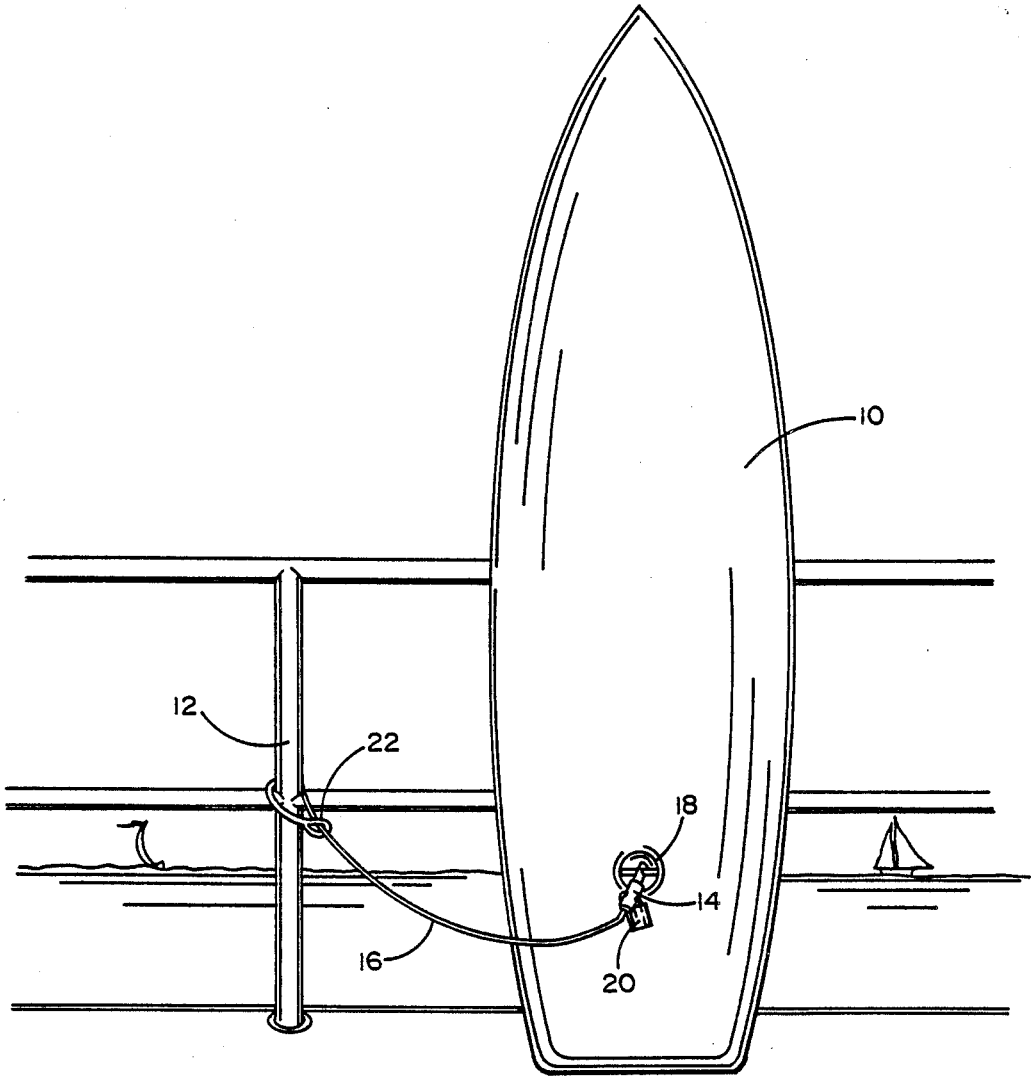
FIG. 1 is a perspective view of the securing device in use on a surfboard

Referring to FIG. 1 of the drawings, a surfboard 10 is securely attached to a fixed object 12 by means of a length of cable 16 securely attached to a securing device 14 and locked with a typical mid-sized padlock 20 to the leash plug 18 contained in surfboard 10. The cable 16 has a fixed loop 22 at end opposite securing device 14 which permits the user to wrap the cable 16 around a fixed object 12 then pass the securing device 14 through the fixed loop 22 prior to securing the device 14 to surfboard 10.

Figure 2:
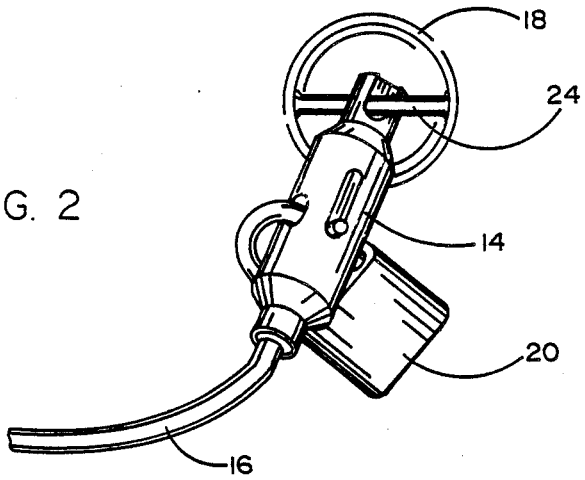
FIG. 2 is an enlarged perspective view of the body and sleeve of the securing device, locked with a padlock to the metal pin of a leash plug.

FIG. 2 shows securing device 14 and attached cable 16 held in a closed position by padlock 20 capturing the metal pin 24 that is contained in leash plug 18.

Figure 3:
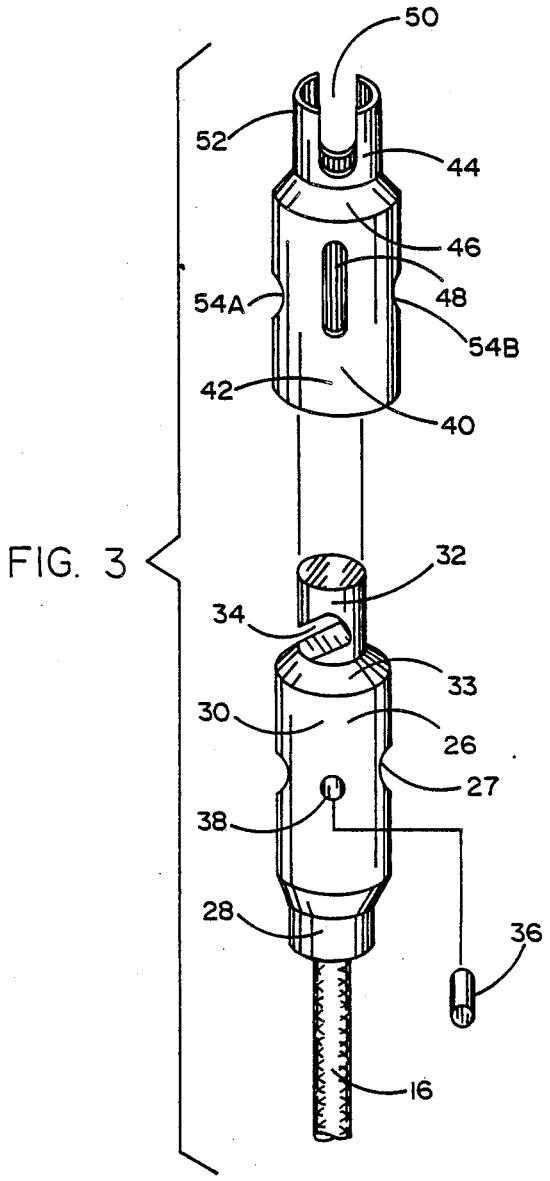
FIG. 3 is an exploded perspective view of the basic components of the securing device.

FIG. 3 shows the generally circularly symmetric, longitudinally elongated body 26 of the securing device 14 (FIG. 2), with the rear end 28 of body 26 securely attached to cable 16. Body 26 of securing device 14 (FIG. 2) has a generally cylindrical shaped center part 30, with a hole 27 extending radially through center part 30. Center part 30 of body 26 tapers to a smaller diameter rear cylindrical section 28. Center part 30 of body 26 tapers to a smaller diameter front cylindrical section 32 through a tapered annular transition section 33. A semi-circular cross section notch 34 extends transversely through front section 32. Pin 36 projects radially outward from hole 38 in outer surface of center 30 of body 26. A hollow cylindrical sleeve 40 is adapted to slide longitudinally over body 26. Sleeve 40 has rear section 42 having the shape of a hollow cylindrical tube. The inner diameter of rear section 42 of sleeve 40 is slightly larger than the outer diameter of center part 30 of body 26, adapting the sleeve 40 to slide longitudinally downwards on body 26. Sleeve 40 tapers to smaller diameter front tubular section 44 through tapered annular transition section 46. The inner diameter of front section 44 of sleeve 40 is slightly larger than the outer diameter of front cylindrical section 32 of body 26. Sleeve 40 has a longitudinal groove 48 shaped complimentarily to pin 36 in body 26 to secure sleeve 40 against rotation in relative to body 26 while sleeve 40 slides longitudinally with respect to the body 26. Sleeve 40 has a transversely disposed, generally rectangular cross-section notch 50 cut downward into outer annular wall section 52 of front tubular section 44. Sleeve 40 has two indexed holes 54A and 54B provided through opposite semi cylindrical wall surfaces 56A and 56B.

Figure 4:
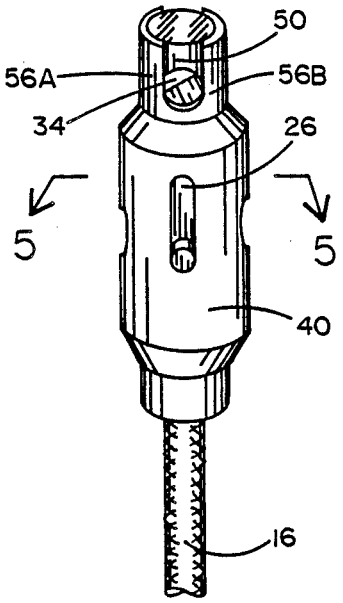
FIG. 4 is an enlarged perspective view of the body and sleeve of the securing device.
Figure 5:
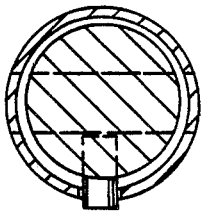
FIG. 5 is a cross section view of the body and sleeve in their normal relationship.

FIG. 4 shows sleeve 40 slid forward on body 26 with notch 50 in sleeve 40 radially aligned with notch 34 in body 26, thus capable of captivating pin 24 (FIG. 2) of leash plug 18 (FIG. 2) between the opposite semi-cylindrical walls 56A and 56B adjacent notch 34 of body 26. In this position, hole 26 (FIG. 3) through body 26 is aligned with indexed holes 54A and 54B (FIG. 3) provided through opposite cylindrical wall surfaces 56A and 56B of sleeve 40, permitting the shackle 58 (FIG. 7) of a padlock 20 (FIG. 7) to be passed through holes 54A and 54B (FIG. 3) in sleeve 40 and hole 27 (FIG. 3) in body 26 to secure device 14 (FIG. 2) in a locked position capturing pin 24 (FIG. 2) of leash plug (FIG. 2).

FIG. 6 shows sleeve 40 slid backwards down upon body 26 until annular transition section 46 (FIG. 3) on complementarily shaped annular transition section 33 (FIG. 3) of body 26.

FIG. 8 shows the most commonly used leash plug which consists of a small cylindrical plastic and metal plug 18 mounted flush within the flat upper surface of a surfboard 10 (FIG. 1). A metal pin 24 is radially disposed between the inner cylindrical wall surfaces 60A and 60B of the leash plug 18 to provide an attachment point for a surf leash (not illustrated).

OPERATION OF INVENTION

The securing device of FIGS. 1–5, specifically 14, is comprised of a body 26, securely attached to a cable 16. A sleeve 40 slides longitudinally over body 26. A fixed loop 22 is in the end of cable 16 opposite end attached to body 26. FIG. 1 shows the securing device 14 with attached cable 16 wrapped around a fixed object 12. Once in place around the fixed object 12, the securing device 14 is passed through the loop 22 in the cable 16. The securing device 14 and the attached cable 16 can then be passed through any object containing an opening large enough to allow passage, such as the sleeve of a wetsuit or surf fins (not illustrated). The notch 34 of body 26 of securing device 14 is fit around the metal pin 24 of a leash plug 18. The sleeve 40 of the securing device 14 is then slid forward on body 26 with notches 50A and 50B in sleeve 40 radially aligning with the notch 34 in body 26 thus captivating pin 24 of leash plug 18. In this position, the holes 54A and 54B of sleeve 40 align with the hole 27 of body 26. A padlock 20 will be passed through holes 54A and 54B of sleeve 40 and hole 27 of body 26 thus securing the surfboard 10, as well as any items through which the cable 16 has passed such as a wetsuit sleeve or leg, to the fixed object 46.

CONCLUSION, RAMIFICATIONS AND SCOPE OF INVENTION

Thus the reader will see that due to securing device's ability to attach and be locked to the leash plug contained in virtually all surfboards, the present invention provides a highly reliable device for the security of a surfboard, which allows the user to secure the surfboard without any modifications being made to the surfboard or risking damage to the fragile fiberglass exterior of the surfboard.

While the above description contains many specifications, these should not be construed as limitations on the scope of the invention, but rather as an exemplification of one preferred embodiment thereof. Many other variations are possible. For example another use of this device would be to attach the device to the spoke of a bicycle, in the same manner as attaching and locking to the metal pin of a leash plug, thus securing a bicycle wheel to any fixed object. Accordingly, the scope of the invention should be determined not by the embodiment illustrated, but by the appended claims and their legal equivalents.

I claim:

1. A device for securing surfboards and other relate recreational implements to a fixed object comprising, a mechanism capable of being locked with a typical mid-sized padlock to a metal pin contained within a leash plug contained with a surfboard, said mechanism having an opening capable of accepting a shackle of a padlock, said mechanism having attached at one end a length of cable, said cable having a fixed loop at end opposite said mechanism, said loop in said cable having an inner diameter large enough to allow the passage of said mechanism, as to allow the user to wrap said mechanism and said cable around a fixed object, then pass said mechanism through said loop prior to securing said mechanism to said leash plug and locking in place with said padlock, a generally circularly symmetric, longitudinally elongated body, said body having a generally cylindrical shaped center, said body having a hole extending radially through said center, said body having a taper at the rear end to a smaller diameter rear cylindrical section, said body having a taper at the front end to a smaller diameter front cylindrical section, said front section of said body having a semi-circular cross section notch extending transversely through said front section, said body having a pin extending radially outward from said center section, said body having a length of cable securely attached to said rear end, a hollow cylindrical sleeve having an inner diameter slightly larger than the outer diameter of said center of said body adapting said sleeve to slide longitudinally downwards on said body, said sleeve having a rear section tapering to a smaller diameter tubular front section said front section of said sleeve having an inner diameter slightly larger than the outer diameter of said front section of said body, said sleeve having a longitudinal groove complementarily shaped to said pin in said body to secure said sleeve against rotation relative to said body while said sleeve slides with respect to said body, said front section of said sleeve having a transversely disposed cross section notch extending longitudinally, said sleeve having two opposite holes extending radially through center of said sleeve, said length of cable having a fixed loop at end opposite said body, said fixed loop having an inner diameter larger than the outer diameter of said sleeve said body, said sleeve, and said cable to be joined in such a manner as to allow the user to put said cable around a fixed object and attach said body and said sleeve to the metal pin contained within the leash plug of a surfboard in such a manner that when said sleeve is slid forward on said body, said notch in said sleeve is radially aligned with said notch in said body causing said metal pin contained in said leash plug to be captivated, further when said sleeve and said body are aligned in such a manner as to contain said metal pin of said leash plug, said hole in said body and said holes in said sleeve are aligned in such a manner as to allow the shackle of a padlock to be passed through said hole in said body and said holes in said sleeve, thereby locking said device to said leash plug and hence securing said surfboard to said fixed object.

2. A device for securing surfboards as claimed in claim 1 including, said front section of said sleeve having an outside diameter of less than ½" for a length of not less than ¼", said notch in said sleeve greater than ⅛" in width and greater than ¼" in length, said notch in said body greaer than ⅛" in width and greater than ⅛" in length, said hole in said body greater than 3/16" in diameter, said holes in said sleeve greater than 3/16" in diameter.

* * * * *